United States Patent [19]

Peterson et al.

[11] Patent Number: 4,872,135

[45] Date of Patent: Oct. 3, 1989

[54] DOUBLE PINHOLE SPATIAL PHASE CORRELATOR APPARATUS

[75] Inventors: Phillip R. Peterson, Albuquerque; Joseph M. Geary, Edgewood, both of N. Mex.

[73] Assignee: The United States of America as represented by the Secretary of the Air Force, Washington, D.C.

[21] Appl. No.: 679,333

[22] Filed: Dec. 7, 1984

[51] Int. Cl.[4] ..... G06G 9/00

[52] U.S. Cl. ..... 364/822

[58] Field of Search ..... 364/822

[56] References Cited

U.S. PATENT DOCUMENTS

| | | | |
|---|---|---|---|
| 3,398,269 | 8/1968 | Williams | 235/181 |
| 3,453,048 | 7/1969 | Williams | 356/71 |
| 3,488,106 | 1/1970 | Lohmann | 350/162 |
| 3,768,907 | 10/1973 | Williams | 356/71 |
| 3,903,407 | 9/1975 | Burnham | 235/181 |

OTHER PUBLICATIONS

Stone, J. M. *Radiation and Optics,* pp. 220 and 221 McGraw-Hill, N.Y., 1963.

Goodman, J. W., *Fourier Optics,* p. 61, McGraw-Hill, N.Y., 1968.

Stone, *Radiation and Optics,* McGraw-Hill, N.Y., 1963 BAA Section 7-1, pp. 115-117.

Stone, J. M., *Radiation and Optics,* McGraw-Hill, N.Y. 1963, pp. 132 and 295-303.

*Primary Examiner*—Bruce Y. Arnold

*Attorney, Agent, or Firm*—William Stepanishen; Donald J. Singer

[57] ABSTRACT

A random wavefront is incident on an aperture plate with a double pinhole of variable separation that is followed by Fourier transforming optics which focuses an intensity profile on a detector array. The detector array is located in the Fourier transform plane of the Fourier transform lens. The time average of the intensity as a function of hole separation yields the root mean square phase and the phase correlation function of the applied wavefront.

6 Claims, 1 Drawing Sheet

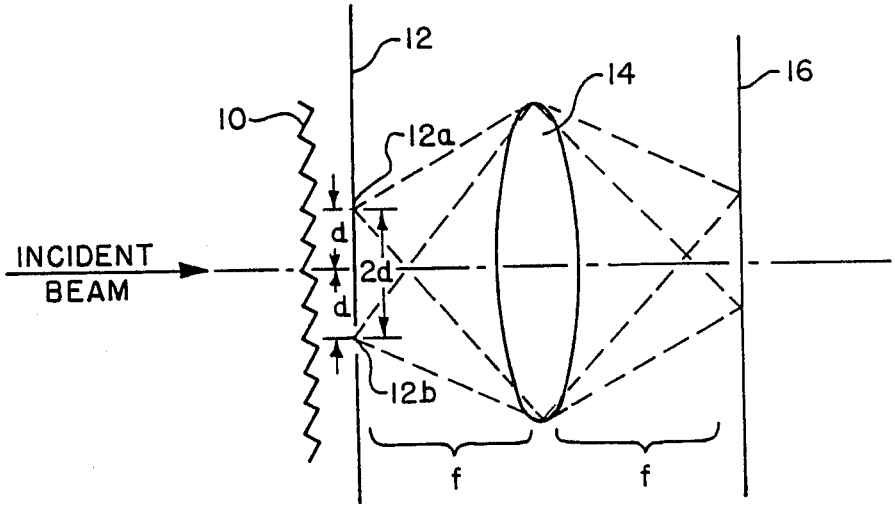
12
14
16
10
12a
d
INCIDENT
BEAM
2d
d
12b
f
f

DOUBLE PINHOLE SPATIAL PHASE CORRELATOR APPARATUS

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to a spatial phase correlator apparatus, and in particular to a double pinhole spatial phase correlator apparatus.

In the prior art various techniques have been utilized to achieve spatial correlation. One known technique utilizes a partially coherent optical correlator which includes an adjustable slit that is used in producing a plurality of correlation samples which are added incoherently in an energy detector. Repeated scanning cycles are used to develop the full partially coherent correlation function. An additional attempt at correlation is through the use of a binary mask as an optical filter.

A partially coherent optical correlator has been developed in the prior art. It is formed by utilizing a non-coherent light source in place of the point light source, and condensing and collimating lenses and associated slits of a fully coherent optical correlator. An axially movable lens provides means for adjusting the coherence interval to optimize the correlator output in accordance with the amount of time-base distortion present in the received signal. This is accomplished practically by adjusting the position of a lens so that each point in the non-coherent source forms a circle of light of proper diameter on the signal plane, with adjacent circles overlapping each other. A total integration is performed by correlating over the diameter of each circle and summing all such correlations incoherently for all circles in the aperture. The present invention utilizes a double pinhole aperture with variable spacing between the pinholes.

SUMMARY OF THE INVENTION

The present invention utilizes a double pinhole spatial phase correlator comprising a double pinhole arrangement of variable separation on which a random wavefront is incident and a Fourier transforming optical system for forming an intensity profile on an output detector array. The time average of the intensity as a function of the pinhole separation yields a root mean square phase and the phase correlation function.

It is one object of the present invention, therefore, to provide an improved spatial phase correlator apparatus.

It is another object of the invention to provide an improved spatial phase correlator apparatus to optically determine the phase correlation function and variance of a random wavefront.

It is another object of the invention to provide an improved spatial phase correlator apparatus use of Fourier optics to transform a random wavefront sampled by two pinholes of variable separation.

It is another object of the invention to provide an improved spatial phase correlator apparatus wherein the time average intensity of the image as a function of hole separation gives information concerning the statistical characteristics of the wavefront.

It is another object of the invention to provide an improved spatial phase correlator apparatus which can be used to describe surface roughness, high-frequency random aero-induced aberrations of any random wavefront.

These and other advantages, objects and features of the invention will become more apparent after considering the following description taken in conjunction with the illustrative embodiment in the accompanying drawings.

BRIEF DESCRIPTION OF THE DRAWINGS

The sole FIGURE is a schematic diagram of the double pinhole spatial phase correlator apparatus according to the present invention.

DESCRIPTION OF THE PREFERRED EMBODIMENT

Referring now to the sole FIGURE there is shown a double pinhole spatial phase correlator apparatus wherein a coherent random wavefront 10 is incident on an aperture plate. It is the statistical properties of this wavefront 10 which the remaining components will yield. The aperture plate 12 includes two pinholes 12*a, b* whose hole spacing is variable within the limits given in the FIGURE. The limits of the pinhole 12*a, b* spacing range from the smallest finite distinct spacing between the two pinholes to the limit of the lens diameter. The aperture plate 12 may comprise any suitable material which is effectively opaque with respect to the incident random wavefront 10. The aperture plate 12 may comprise a plate wherein the spacing between the pinholes 12*a, b* is continuously variable or may comprise a series of individual plates having the desired pinhole spacing fixed thereon.

The Fourier transform lens 14 has a focal length f at which focal points is positioned respectively the aperture plate 12 and the detector array 16. The lens 14 with a focal length f, forms a Fourier transform of the product of the wavefront with the transparency. A detector array 16 which is located at the focal length of the Fourier transform lens 14, is in the Fourier transform plane (FTP) of the lens 14. The detector 16 may comprise any suitable conventional or commercially available material or elements such as a CCD array.

The average properties of the intensity distribution of the wavefront 10 in the Fourier transform plane (FTP) as the hole separation is changed will be detected by the detector 16. It is the array detected data which gives the wavefront phase correlation function. The following analysis will explain and establish the wavefront correlation function:

Step 1.

The random wavefront field incident on the aperture plate is:

$$U(x)=e^{i\phi(x)} \tag{1}$$

Step 2.

The aperture plate is represented by the Dirac delta function:

$$T(x)=\delta(x+d)+\delta(x-d) \tag{2}$$

where the hole separation is 2d.

Step 3.

The field incident on the Fourier optics systems is then the product:

$$U(x)T(x)=e^{i\phi(x)}[\delta(x+d)+\delta(x-d)] \tag{3}$$

Step 4.

The field at the detector, $U_d(x_o)$, array is the Fourier transform of Step 3, that is :

$$U_d(x_o) = K \int e^{ixx_o} e^{i\phi(x)} [\delta(x+d) + \delta(x-d)] \quad (4)$$
$$= K[e^{-ix_od} e^{i\phi(-d)} + e^{ix_od} e^{i\phi(d)}]$$

Step 5.

The detected intensity at one instant of time (or one ensemble member) is:

$$I(x_o) = U_d(x_o)U_d^*(x_o) = K[2 + e^{-2ix_od}e^{i[\phi(-d)-\phi(d)]} + e^{2ix_od}e^{i[\phi(d)-\phi(-d)]}] \quad (5)$$

Step 6.

The average intensity, denoted by $<\cdot>$, is then $$I(x_o) = 2K[1 + <e^{i[\phi(d)-\phi(-d)]}> \text{Cos } 2x_od] \quad (6)$$

since $<\cdot>$ is a real function.

Step 7.

Calculating the visibility v(d) gives $$V(d) = <e^{i[\phi(d)-\phi(-d)]}> \quad (7)$$

which describes the random wavefront properties. In particular, using standard assumptions concerning random phase properties this becomes:

$$V(d) = e^{-\Sigma 2(1-C(|2d|))} \quad (8)$$

Thus, the visibility as a function of d gives the wavefront RMS error $\sigma$ and the phase correlation function C(|2d|). Thus the proof that the above invention yields the phase correlation function and variance, is complete.

The random wavefront can be generated in numerous ways; for example, transmission through ground glass, reflection from a rough surface, transmission through turbulent gas. The only requirement is that the wavefront can be described in terms of a phase correlation function.

In step 6 it is shown that the average intensity for a given hole separation d is formed. An example of how this could be accomplished is now presented. Assume that the wavefront is generated by transmission through a ground glass plate. First, one marks N different positions on the glass plate. Then the double pinhole, for a fixed hole separation d, is placed at the first point and the intensity $I_1(x_o)$ is measured. Next, the ground glass is moved to the second point and $I_2(x_o)$ is measured. This is then repeated for all N positions and each time $I_N(x_o)$ is measured. Then the average intensity is formed:

$$<I(x_o)> = \frac{1}{N} \sum_{j=1}^{N} I_j(x_o) \quad (6')$$

where $$I_j(x_o) = K[2 + e^{-2ix_od}e^{-\Delta\psi_j(d)} + e^{2ix_od}e^{\Delta\psi_j(d)}]$$

and $$\Delta\psi_j(d) = [\phi(-d) - \phi(d)]_j$$

and is the random phase difference at the $j^{th}$ position on the ground glass. Mathematically, Eq. (6') is equivalent to Eq. (6); that is, $$<I(x_o)> = 2K[1 + <e^{i\Delta\phi(d)}> \text{Cos } 2x_od]$$

Next the average visibility is formed from the ratio $$V(d) = \frac{<I(x_o)>\max - <I(x_o)>\min}{<I(x_o)>\max + <I(x_o)>\min} \quad (7')$$

and after inserting Eq. (6) or (6') into Eq. (7') becomes:

$$V(d) = e^{i\Delta\psi(d)} \quad (7)$$

There is now established one point on the visibilty curve for the fixed hole separation d. Finally, the above procedure is repeated as the hole separation is changed. This generates the visibility as a function of d, and it will have the function form:

$$V(d) = e^{-\sigma 2(1-C(|2d|))}$$

The concluding step is to curve fit V(d) and hence extract $\sigma^2$ and the phase correlation function C( 2d ).

Although the invention has been described with reference to a particular embodiment, it will be understood to those skilled in the art that the invention is capable of a variety of alternative embodiments within the spirit and scope of the appended claims.

What is claimed is:

1. A double pinhole spatial phase correlator apparatus comprising in combination:

an aperture plate with a first and second pinhole spaced symmetrically about a center line which is perpendicular to said aperture plate, said aperture plate receiving a random wavefront which is incident to said aperture plate, the spacing of said first and second pinhole being variable within a predetermined limit, a Fourier transform lens means positioned symmetrically about said center line of said aperture plate substantially parallel thereto and at a distance therefrom equal to said focal length f, and a detector means formed in a plane substantially parallel to both said aperture plate and said Fourier transform lens means, said detector means symmetrically positioned about said center line of said aperture plate, said detector means positioned at a distance equal to said focal length f from said Fourier tranform lens means, said wavefront being applied through said first and second pinhole to said Fourier transform lens means, said Fourier transform lens means forms a Fourier transform of said wavefront which is applied to said detector means to provide the wavefront phase correlation function.

2. A double pinhole spatial phase correlator apparatus as described in claim 1 wherein said Fourier transform lens means comprises a Fourier transform lens.

3. A double pinhole spatial phase correlator apparatus as described in claim 2 wherein said detector means comprises an array of CCD elements.

4. A double pinhole spatial phase correlator apparatus as described in claim 3 wherein said predetermined limit of said spacing of said first and second pinhole is equal to the smallest distinct spacing between the two pinholes to the limit of the diameter of said Fourier transform lens.

5. A double pinhole spatial phase correlator apparatus as described in claim 4 wherein said spacing of said first and second pinhole may be varied in discrete steps.

6. A double pinhole spatial phase correlator apparatus as described in claim 4 wherein said spacing of said first and second pinhole may be varied continuously.

* * * * *

UNITED STATES PATENT AND TRADEMARK OFFICE

CERTIFICATE OF CORRECTION

PATENT NO. : 4,872,135

DATED : October 3, 1989

INVENTOR(S) : Phillip R. Peterson et al

It is certified that error appears in the above-identified patent and that said Letters Patent is hereby corrected as shown below:

In column 3, lines 11-14, delete "ensemble member) is:

$$I(x_o)=U_d(x_o)U_d^*(x_o)=K[2+e^{-2ix_od}e^{i-}$$

$$[\phi(-d)-\phi(d)]+e^{2ixod}e[\phi(d)-\phi(-d)]] \qquad (5)"$$

and substitute therefore --ensemble member)is: $I(x_o) = U_d(x_o)U_d^*(x_o)$ $$= K[2+e^{-2ix_od}e^{i[\phi(-d)-\phi(d)]}+e^{2ix_od}e^{i[\phi(d)-\phi(-d)]}] \qquad (5)--;$$

UNITED STATES PATENT AND TRADEMARK OFFICE

CERTIFICATE OF CORRECTION

PATENT NO. : 4,872,135

DATED : October 3, 1989

INVENTOR(S) : Phillip R. Peterson et al

It is certified that error appears in the above-identified patent and that said Letters Patent is hereby corrected as shown below:

In column 3, line 29, equation (8),

"$V(d) = e^{-\Sigma 2(1-C(|2d|))}$" should read

--$V(d)=e^{-\sigma 2(1-C(|2d|))}$--.

Signed and Sealed this

Eleventh Day of December, 1990

*Attest:*

HARRY F. MANBECK, JR.

*Attesting Officer*

*Commissioner of Patents and Trademarks*